US010477942B2

(12) United States Patent
Badie et al.

(10) Patent No.: US 10,477,942 B2
(45) Date of Patent: Nov. 19, 2019

(54) APPLICATOR TIP FOR COSMETIC PRODUCT, ASSOCIATED APPLICATOR AND APPLICATOR ASSEMBLY

(71) Applicant: ALBEA SERVICES, Gennevilliers (FR)

(72) Inventors: Aurelie Badie, Pontoise (FR); Thomas Bonnin, Pronleroy (FR); Anne Rutigliano, Maisons-Laffitte (FR)

(73) Assignee: ALBEA SERVICES, Gennevilliers (FR)

( * ) Notice: Subject to any disclaimer, the term of this patent is extended or adjusted under 35 U.S.C. 154(b) by 138 days.

(21) Appl. No.: 15/500,098

(22) PCT Filed: Jul. 24, 2015

(86) PCT No.: PCT/EP2015/067024
§ 371 (c)(1),
(2) Date: Jan. 29, 2017

(87) PCT Pub. No.: WO2016/016133
PCT Pub. Date: Feb. 4, 2016

(65) Prior Publication Data

US 2017/0265619 A1 Sep. 21, 2017

(30) Foreign Application Priority Data

Jul. 29, 2014 (FR) ..... 14 57319

(51) Int. Cl.
*A45D 34/04* (2006.01)

(52) U.S. Cl.
CPC ..... *A45D 34/046* (2013.01)

(58) Field of Classification Search
CPC ... A45D 34/042; A45D 34/045; A45D 40/265
See application file for complete search history.

(56) References Cited

U.S. PATENT DOCUMENTS 5,716,150 A * 2/1998 Gueret ..... A45D 40/267 401/128
6,082,918 A 7/2000 Oreal
6,227,737 B1 * 5/2001 Lightfoot ..... A45D 40/265 118/264
6,592,280 B2 * 7/2003 Petrich ..... A61C 5/62 401/126
7,112,062 B2 * 9/2006 Lee ..... A61C 5/60 206/63.5
7,475,692 B2 * 1/2009 Hartstock ..... A45D 34/042 132/218

(Continued)

*Primary Examiner* — David P Angwin
*Assistant Examiner* — Bradley S Oliver
(74) *Attorney, Agent, or Firm* — Steven M. Greenberg, Esq.; Shutts & Bowen LLP

(57) ABSTRACT

The invention relates to an applicator tip (10) for cosmetic product, said applicator tip (10) comprising a fixing part for fixing to a support rod, and an application part (20, 20') for applying said product, said application part (20, 20') having at least two opposing rounded applicator faces (F1, F2) that are hinged to said fixing part (14) and extend as far as a distal end (16) of the applicator (10), said rounded faces (F1, F2) having a radius of curvature (R1, R2) of less than 6 mm. The invention also relates to an associated applicator and applicator assembly.

11 Claims, 3 Drawing Sheets

(56) References Cited

U.S. PATENT DOCUMENTS

| | | | | |
|---|---|---|---|---|
| 7,959,370 | B2 * | 6/2011 | Pierson | A61C 3/005 401/126 |
| 8,210,763 | B2 * | 7/2012 | Gueret | A45D 40/265 15/204 |
| 8,783,268 | B2 * | 7/2014 | Gueret | A45D 40/265 132/218 |
| 8,894,311 | B2 * | 11/2014 | Gueret | A45D 40/265 401/130 |
| 9,033,604 | B2 * | 5/2015 | Gueret | A45D 40/265 401/129 |
| 10,010,151 | B2 * | 7/2018 | Gueret | A45D 34/045 |
| 2008/0038043 | A1 * | 2/2008 | Tranchant | A45D 34/042 401/128 |
| 2009/0065018 | A1 | 3/2009 | Berhault | |
| 2010/0266327 | A1 * | 10/2010 | Lin | A45D 40/267 401/122 |
| 2011/0176856 | A1 | 7/2011 | Gardner et al. | |
| 2015/0020836 | A1 | 1/2015 | Oreal | |
| 2017/0181524 | A1 * | 6/2017 | Thiebaut | A45D 34/04 |

* cited by examiner

APPLICATOR TIP FOR COSMETIC PRODUCT, ASSOCIATED APPLICATOR AND APPLICATOR ASSEMBLY

CROSS-REFERENCE TO RELATED APPLICATIONS

This application is a § 371 national phase entry of International Application No. PCT/EP2015/067024, filed Jul. 24, 2015, which claims priority to French Patent Application No. 1457319, filed Jul. 29, 2014.

The invention relates to an applicator tip for cosmetic product, and to an associated applicator and applicator assembly.

Applicator assemblies for cosmetic product are known, in particular for cosmetic product that is intended to be applied to the lips of a user. Said applicator assemblies comprise a receptacle containing the cosmetic product, and an applicator that is suitable for being removably fixed to the receptacle.

The receptacle generally comprises a body, the body comprising walls delimiting a container which contains the cosmetic product, and a neck defining an opening through which the cosmetic product can be removed. The applicator generally comprises a cap suitable for being fixed to the neck, a rod extending from the cap, and an applicator tip fixed to a free end of the rod.

When the cap is fixed on the neck, the rod and the applicator tip extend inside the container. The applicator is immersed in the cosmetic product contained in the container.

In order to use the applicator, the user detaches the cap from the neck and removes the applicator from the receptacle.

The known applicator tips generally have a spatula-shaped region that is intended to come into contact with lips to which the product is to be applied, in particular in order to load said lips with cosmetic product. The flexibility thereof is appreciated. However, said spatula-shaped region usually only permits local application of cosmetic product, in particular on just one lip at a time.

The present invention aims to propose an applicator tip that makes it possible to apply product, in a single application, to both lips of a user, while maintaining comfort of use during the product application.

The invention therefore relates to an applicator tip for cosmetic product, said applicator tip comprising a fixing part for fixing to a support rod, and an application part for applying said product, said application part having at least two opposing rounded applicator faces that are hinged to said fixing part and extend as far as a distal end of the applicator in a main direction of longitudinal extension, referred to as the main direction.

According to the invention, said rounded faces have a radius of curvature of less than 6 mm, said fixing part comprising a sleeve, said application part being connected to said sleeve by means of a flexible part, referred to as a restriction, such that said application part is rotatable relative to said sleeve about at least two axes of an orthonormal coordinate system, said restriction being rounded and substantially concave in shape, in particular when it is viewed in a plane that is transverse to said main direction, said rounded shape having a radius of curvature of less than 6 mm.

The applicator tip of the invention comprises an application part having two rounded applicator faces, said rounded faces giving the application part a curved shape. Said application part thus has an extended application surface which makes it possible to apply cosmetic product to both lips of a user, in particular from the first passage of the applicator. The hinging of said applicator faces makes it possible, in addition, to maintain the application sensations encountered using the spatula of the prior art.

According to different embodiments of the invention, which can be taken together or in isolation:

- said application part is spherical in shape,
- said application part is substantially conical in shape,
- said restriction has a cross section, in particular transverse to the main direction, that is substantially cylindrical in shape and the diameter of which is at least equal to 1.5 mm,
- said diameter of said restriction is between 1.5 mm and 3 mm,
- the sleeve has a main direction of longitudinal extension that is coincident with the main direction of the applicator tip,
- the sleeve, the restriction and the application part are moulded parts,
- the sleeve, the restriction and the application part are mutually integral,
- the restriction comprises an elastomer material,
- said elastomer material has a hardness of greater than or equal to approximately 60 Shore A,
- said elastomer material has a hardness of between approximately 60 Shore A and approximately 90 Shore A, inclusive of the boundaries of this range,
- said elastomer material is a copolymer, in particular a polystyrene-b-poly (ethylene-butylene)-b-polystyrene (SEBS),
- said application part is smooth and/or flocked,
- the flocking of said application part comprises cotton,
- said applicator tip is a solid part.

The invention also relates to an applicator comprising an applicator tip as described above. Advantageously:

- said rod, which is substantially cylindrical, has a diameter D,
- said application part has a diameter d,
- the two diameters D, d are linked by the following formula: $0.89 \leq d/D \leq 0.99$,
- the rod has a main direction of longitudinal extension that is coincident with said main direction of the applicator.

The invention also relates to an applicator assembly for cosmetic product, comprising a receptacle comprising a body which forms a container intended to contain the cosmetic product, and an applicator as described above that is suitable for being fixed to the receptacle such that the applicator tip is housed within the container.

According to different embodiments of the invention, which can be taken together or in isolation:

- the receptacle further comprises a neck that defines an opening through which the cosmetic product can be removed, and a wiper that is fixed to the inside of said neck,
- the applicator assembly further comprises a cap that is suitable for being fixed to the neck, said rod extending from the cap,
- the wiper comprises a wiping aperture that is designed to wipe the excess cosmetic product from the applicator,
- the diameter of the wiping aperture is substantially the same as that of the rod of the applicator.

The invention further relates to said applicator assembly, the container of which is filled with cosmetic product, said product being intended in particular to be applied to the lips of a user.

The invention will be better understood, and its other aims, details, features and advantages will become more clearly apparent in the detailed explanatory description that follows, of at least one embodiment of the invention given as a purely illustrative and non-limiting example, with reference to the accompanying schematic drawings.

In these drawings:

FIGS. 1 and 5 show a first and a second embodiment of an applicator tip 10 for cosmetic product according to the invention.

Said applicator tip 10 extends in a main direction of longitudinal extension, referred to as the main direction and denoted X in the figures. Said applicator tip 10 has a proximal end 13 and a distal end 16 that is opposite said proximal end 13 in said main direction X.

Said applicator tip 10 comprises an application part 20, 20'. "Application part" means a part of the applicator tip that is capable of retaining cosmetic product when said part is brought into contact therewith, and of subsequently releasing said product.

Said application part 20, 20' has at least two opposing applicator faces F1, F2. "Applicator face" means a face that has no protrusions, such as the protrusions of mascara brushes that are used for applying the product.

Figure 1:
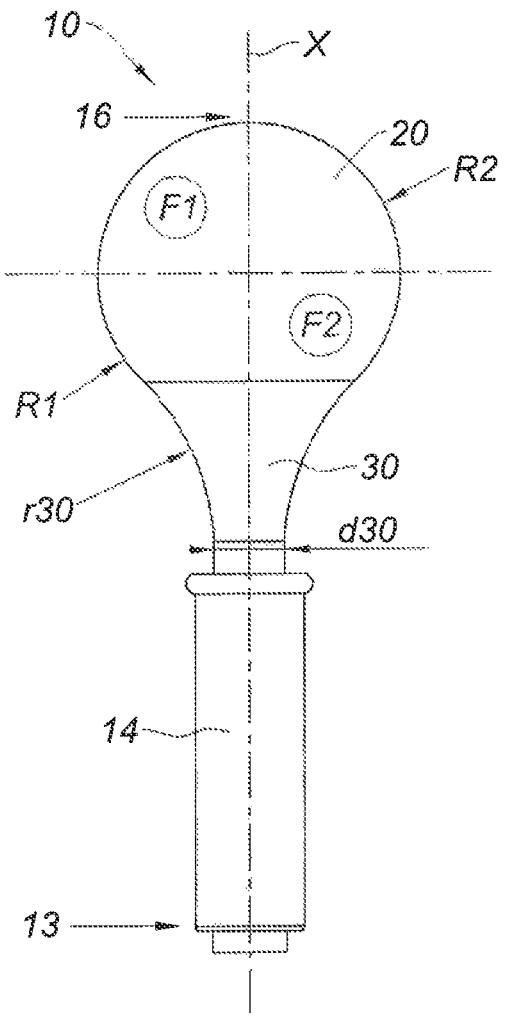
FIG. 1 is a front view of a first embodiment of an applicator tip according to the invention.
Figure 2:
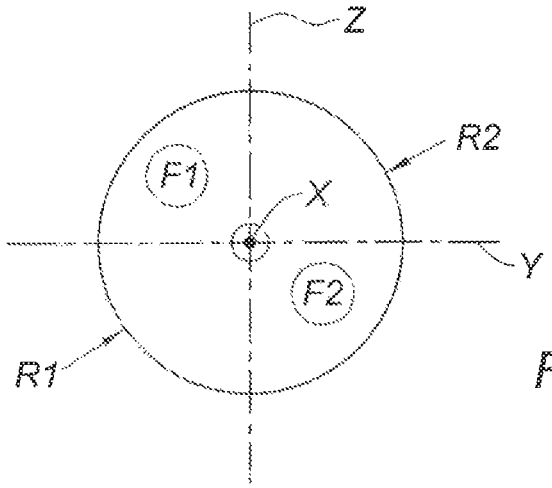
FIG. 2 is a plan view of FIG. 1.

Said applicator faces F1, F2 are rounded and extend as far as the distal end 16 of the applicator tip 10. FIG. 1 shows the curvature of said two faces F1, F2 of said first embodiment in a plane containing the main direction X. FIG. 2 shows the curvature of said two faces F1, F2 in a plane that is transverse to said main direction X (FIG. 2 is a plan view of FIG. 1).

Figure 5:
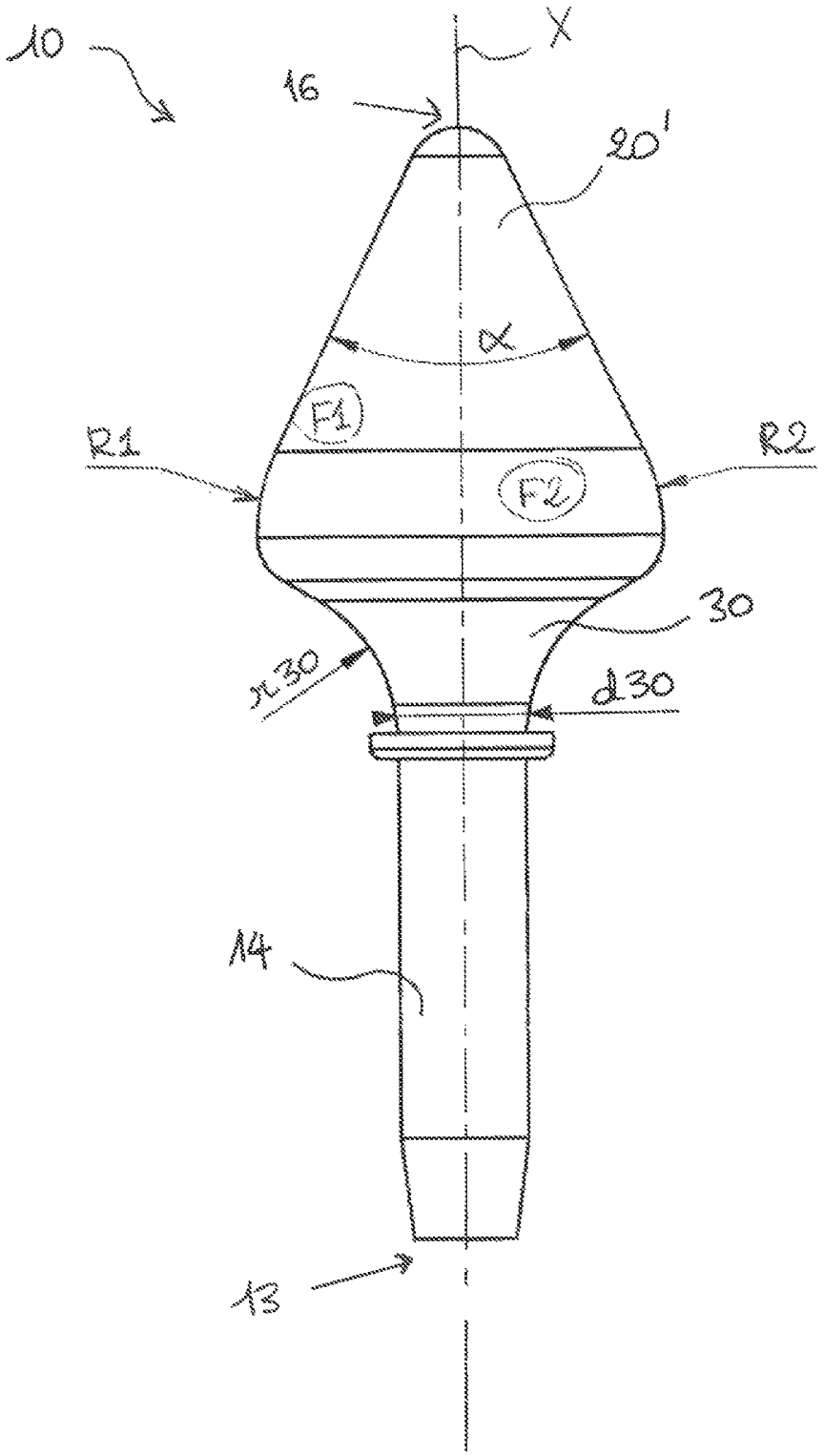
FIG. 5 is a front view of a second embodiment of an applicator tip according to the invention.

FIG. 5 shows the curvature of the two faces F1, F2 of the second embodiment in a plane that contains the main direction X.

It should be noted that said rounded faces F1, F2 have a radius of curvature R1, R2, measured in a plane containing said main direction X and/or in a plane that is transverse to said main direction X, of less than 6 mm.

Said radii of curvature R1, R2 are advantageously equal in order to form a spherical application part 20, 20', in particular within the context of the first embodiment shown in FIGS. 1 and 2.

Within the context of the second embodiment, the application part 20' is spherical in part. Indeed, said radii of curvature R1, R2 are advantageously equal, and non-zero, over at least part of the height of said application part 20'.

Furthermore, the diameter of said application part 20, 20' is, for example, approximately 8 mm.

Within the context of the first embodiment, the application part 20 forms a single sphere.

Within the context of the second embodiment, said application part 20' is substantially conical in shape.

Said substantially conical shape advantageously has a spherical part, as mentioned above.

Said substantially conical shape can also, advantageously, be frustoconical. In other words, the distal end 16 of said shape 20' advantageously has a rounded portion, in particular at the distal end 16 thereof, in order not to form a point.

By way of example, said frustoconical part has a diameter of approximately 8 mm and an angle $\alpha$ formed between said two applicator faces F1, F2, measured in a plane containing said main direction X, of between 40° and 60°, for example of approximately 50°.

According to the invention, said two radii of curvature R1, R2 could also be different, while still being less than 6 mm, in order to form a rotationally asymmetrical application part 20, 20'.

Since said radii of curvature R1, R2 are equal or different, said application part 20, 20' has the advantage of being curved, at least in part, and of having a large application surface on at least two faces. The user can thus apply product to both their lips in a single passage of the applicator tip 10.

Furthermore, said applicator tip 10 comprises a fixing part that, here, is in the form of a sleeve 14.

The application part 20, 20' is advantageously connected to the sleeve 14 by means of a flexible part, referred to as a restriction 30, such that the application part 20, 20' is rotatable relative to said sleeve 14, in particular about at least two axes of an orthonormal coordinate system. Said orthonormal coordinate system is, for example, centred at a point of the main direction X. Thus, said two axes are, for example, the axes denoted Y, Z in FIG. 2.

The application part 20, 20' can also be movable in said direction X. Said application part 20, 20' is then swivellably connected to said sleeve 14 by means of said restriction 30.

Thus, the fact that said application part 20, 20' is movable relative to said sleeve 14 has the advantage of making the applicator tip 10 capable of adapting to a large group of users wishing to apply product therewith.

Said restriction 30 is rounded and substantially concave in shape between said sleeve 14 and said application part 20, 20', in particular when viewed in a plane transverse to the main direction X (see FIG. 1). Said rounded shape has a radius of curvature r30 here of approximately 6 mm. Said radius of curvature r30 can be close to 6 mm without departing from the scope of the invention.

Said radius of curvature can advantageously be less than 6 mm. For example, said radius of curvature can be close to 1 mm, 2 mm, 3 mm, 4 mm, 5 mm or even 6 mm, as mentioned above.

Said rounded shapes of the application part 20, 20' and of said restriction 30 are easy to achieve because the sleeve 14, the restriction 30 and the application part 20, 20' are moulded parts. "Moulded" means parts that can be overmoulded together, or even integral as is the case here.

It should be noted that the restriction 30 advantageously comprises an elastomer material, in particular an elastomer having a hardness that is greater than or equal to approximately 60 Shore A. Indeed, a hardness of less than 40 Shore A would result in an application part 20, 20', integral with said restriction 30, that is sticky and unpleasant to the touch. A hardness of less than 60 Shore A would, in turn, result in the restriction 30 being lengthened until it breaks when said applicator tip 10 is used.

Thus, in order to prevent the application part 20, 20' from becoming disconnected from said sleeve 14, and in order to ensure a feel that is pleasant for the user, said elastomer material advantageously has a hardness of between approximately 60 Shore A and approximately 90 Shore A, inclusive of the boundaries of this range. Said elastomer material is a polystyrene-b-poly(ethylene-butylene)-b-polystyrene (SEBS), for example.

Moreover, in order to prevent the occurrence of a weakening region between the sleeve 14 and the application part 20, 20', in particular at said restriction 30, said restriction 30 has a cross section, in particular transverse to the main direction X, that is substantially cylindrical in shape and of which the diameter d30 is at least equal to 1.5 mm.

According to the invention, said diameter d30 of said restriction 30 is advantageously between 1.5 mm and 3 mm; it can for example be substantially equal to 2 mm, 2.5 mm or even 2.7 mm.

Figure 3:
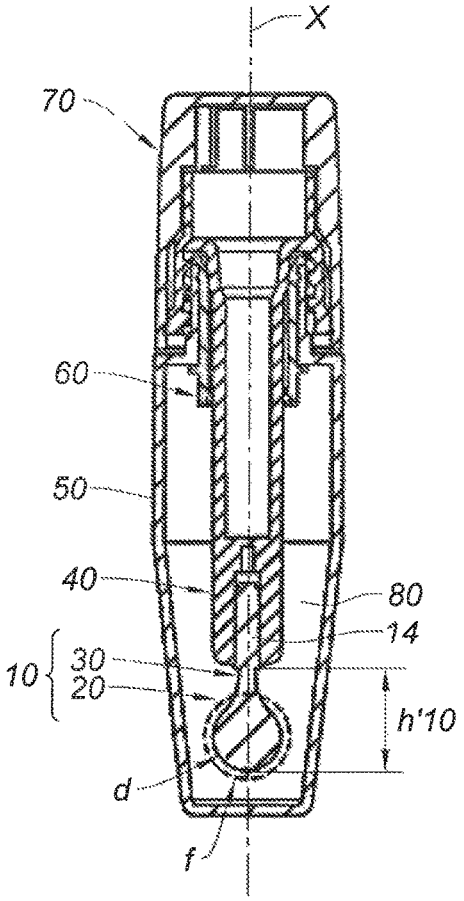
FIG. 3 is a longitudinal sectional view of an embodiment of an applicator assembly according to the invention.

FIG. 3 shows an applicator tip for cosmetic product, comprising a receptacle 50 comprising a body 51 which forms a container intended to contain the cosmetic product, and an applicator comprising a tip 10 such as has just been described. Said applicator is suitable for being fixed to the receptacle 50 such that the applicator tip 10 is housed within the container. Said tip is then immersed in the cosmetic product, denoted 80 in FIG. 3.

FIG. 3 also shows the sleeve 14 joined to a rod 40 of the applicator.

Said rod 40 makes it possible, inter alia, to manipulate said applicator tip 10. More precisely, the applicator comprises a cap 70 that is suitable for being manipulated by the user, and said rod 40 advantageously extends from the cap 70.

It should be noted, here, that said cap 70 is formed of a head 71 that is integral with the rod 40, and of a cowl 72 that is force-fitted and held in position on said head 71 of the rod 40 by means of internal counter shapings that are intended to engage with shapings formed on said head 71. Said cowl 72 is rigid. "Rigid" is intended to mean unable to be deformed, either by atmospheric pressure or by a pressure exerted by the fingers of a user. The user manipulates the applicator of the invention by means of said cowl 72, in particular because said cowl 72 transfers the movement imparted thereto by the user to the head 71 of the rod 49, which itself transmits said movement to the sleeve 14 to which it is joined.

Figure 4:
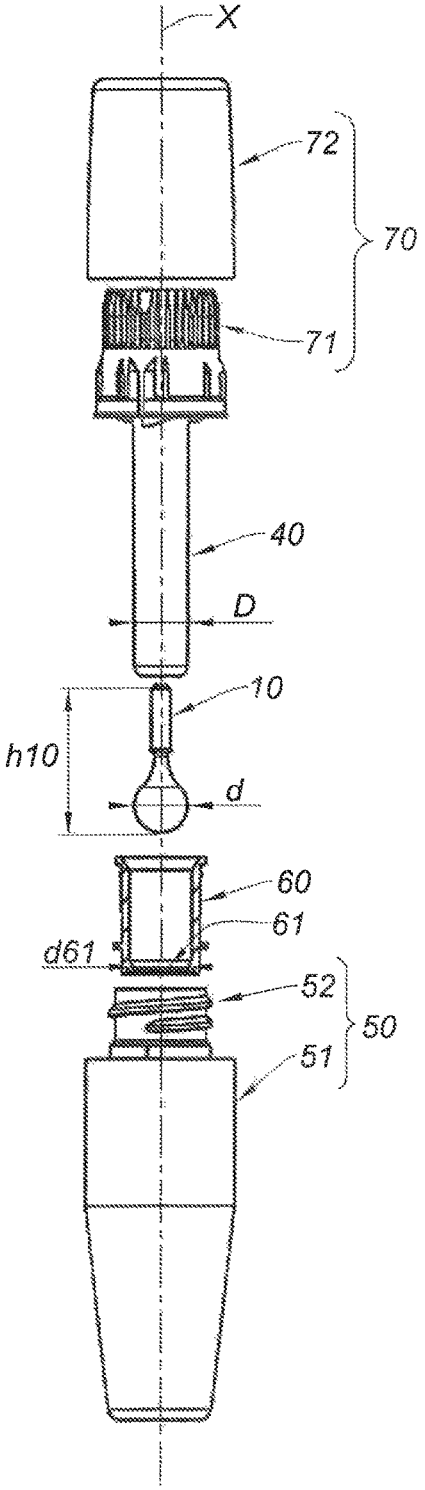
FIG. 4 is an exploded view of the applicator assembly from FIG. 3.

Said cap 70 is intended to be removably fixed to a neck 52 of the receptacle 50 (see FIG. 3 for the assembled version and FIG. 4 for the exploded view).

It should be noted that said sleeve 14 and said rod 40 are each substantially cylindrical in shape and have a main direction of longitudinal extension that is coincident with said main direction X.

It should also be noted that the joint between the sleeve 14 and said rod 40 is a housed joint. In a variant, the applicator tip can be overmoulded on or across the rod.

FIG. 4 is an exploded view of the applicator assembly from FIG. 3. Said FIG. 4 shows the receptacle 50 in detail. In particular, said neck 52 comprises an opening through which the cosmetic product can be removed, and a wiper 60 that is intended to be fixed to the inside of said neck 52.

It can also be seen in FIG. 4 that the wiper 60 comprises a wiping aperture 61 that is designed wipe the excess cosmetic product from the rod 40 and from the applicator tip 10 when said rod and tip pass through said aperture.

The wiping aperture 61 is advantageously cylindrical in shape. However, this selection is non-limiting, and any other shape of the aperture 61 can be selected for the wiper 60 without departing from the scope of the invention.

The diameter d61 of said wiping aperture is advantageously selected relative to the diameter D of the rod 40 and of the applicator tip 10 from which it scrapes the excess loaded product.

In this connection, it should be noted that the diameter D of said rod is comparable to the diameter of the application part 20, 20'. Indeed, since, here, the application part 20, 20' is spherical in shape and thus has a diameter d, said two diameters D, d are advantageously linked by the following formula: $0.89 \leq d/D \leq 0.99$.

Thus, by way of example, the diameter D of the rod 40 can be equal to 8.25 mm and the diameter d of the spherical application part 20, 20' can be equal to 8 mm. This means, moreover, that the diameter D of the rod is substantially the same, or even substantially greater than that of the application part 20, 20'.

It should also be noted that the diameter d61 of the wiping aperture 61 is substantially the same as that of the rod 40. This has the advantage that the product on the applicator tip 10, and in particular the product on the application part 20, 20' of said applicator tip 10, is minimally scraped off.

Thus, as well as having a large application surface, the applicator assembly is designed such that the wiping of the application part 20, 20' is optimised when it is removed from the receptacle 50. In other words, the cosmetic product that the application part 20, 20' is capable of loading is scraped off in an optimised manner by the wiper 60 across which it passes while being removed from said receptacle 50.

This contributes to allowing the applicator tip 10 of the invention to apply product to both lips of a user, even from the first passage of the applicator tip thereover.

Indeed, the invention advantageously relates to an applicator assembly of this kind, the container 50 of which is filled with cosmetic product, said product being intended in particular to be applied to the lips of a user.

Said application part 20, 20' can be smooth. It should be noted, as an alternative that is not excluded from the invention, that said application part 20, 20' has a flocking f on the face thereof (see FIG. 3), said flocking f in particular comprising cotton. According to another variant, said application part 20, 20' can comprise grooves, in particular shallow grooves having a depth in particular of from 200 to 300 micrometres.

Said flocking f allows better retention of cosmetic product and a softer feel. The diameter of the application part 20, 20' provided with said flocking f can be equal to 10 mm, for example.

It should also be noted that said applicator tip 10 is advantageously a solid part.

By way of example, said applicator tip 10 has a height h10 of approximately 22 mm (see FIG. 4) measured between the proximal 13 and distal 16 ends thereof in the main direction X.

By way of example again, said applicator tip 10 has a height h'10 of approximately 12.5 mm (see FIG. 3) when it is joined to the rod 40. In other words, once joined to the rod, the sleeve 14 of said applicator tip 10 is no longer visible because it is housed in said rod 40, in particular at the free end thereof. The visible applicator tip 10 is thus formed by said restriction 30 and said application part 20, 20', and it is the height of these two elements, measured in the main direction X, that is approximately 12.5 mm.

It should also be noted that variants are of course possible. In particular, it is also conceivable, in an additional embodiment, for the applicator tip 10 to be provided so as to be hollow.

The invention claimed is:

1. An applicator tip for cosmetic product, said applicator tip comprising:

a fixing part for fixing to a support rod, and an application part for applying said product, said application part having at least two opposing rounded applicator faces that are hinged to said fixing part and extend as far as a distal end of the applicator in a main direction of longitudinal extension, said rounded applicator faces having a radius of curvature of less than 6 mm, said fixing part comprising a sleeve, said application part being connected to said sleeve by means of a flexible restriction, such that said application part is rotatable relative to said sleeve about at least two axes of an orthonormal coordinate system, said restriction being rounded and substantially concave in shape, and when viewed in a plane that is transverse to said main direction, said rounded shape having a radius of curvature of less than 6 mm and wherein said restriction has a circular cross section that is transverse to the main direction, that is substantially circular in shape and the diameter of which is at least equal to 1.5 mm.

2. The applicator tip according to claim 1, wherein said application part is spherical in shape.

3. The applicator tip according to claim 1, wherein said application part is substantially conical in shape.

4. The applicator tip according to claim 1, wherein said diameter of said restriction is between 1.5 mm and 3 mm.

5. The applicator tip according to claim 1, wherein the sleeve, the restriction and the application part are moulded parts.

6. The applicator tip according to claim 5, wherein the sleeve, the restriction and the application part are mutually integral.

7. The applicator tip according to claim 1, wherein the restriction comprises an elastomer material.

8. The applicator tip according to claim 7, wherein said elastomer material has a hardness of greater than or equal to approximately 60 Shore A.

9. The applicator tip according to claim 7, wherein said elastomer material has a hardness in a range beginning with approximately 60 Shore A and ending at approximately 90 Shore A.

10. An applicator comprising:

an applicator tip comprising a fixing part for fixing to a support rod, and an application part for applying said product, said application part having at least two opposing rounded applicator faces that are hinged to said fixing part and extend as far as a distal end of the applicator in a main direction of longitudinal extension, said rounded applicator faces having a radius of curvature of less than 6 mm, said fixing part comprising a sleeve, said application part being connected to said sleeve by means of a flexible restriction, such that said application part is rotatable relative to said sleeve about at least two axes of an orthonormal coordinate system, said restriction being rounded and substantially concave in shape, and when viewed in a plane that is transverse to said main direction, said rounded shape having a radius of curvature of less than 6 mm and wherein said restriction has a circular cross section that is transverse to the main direction, that is substantially circular in shape and the diameter of which is at least equal to 1.5 mm, wherein said support rod is substantially cylindrical in shape and has a diameter D, said application part having a diameter d, said two diameters D, d being linked by the following formula: $0.89 \leq d/D \leq 0.99$.

11. An applicator assembly for cosmetic product, comprising:

a receptacle comprising a body forming a container intended to contain the cosmetic product, and an applicator suitable for being fixed to the receptacle such that the applicator is housed within the container, the applicator comprising:

an applicator tip comprising a fixing part for fixing to a support rod, and an application part for applying said product, said application part having at least two opposing rounded applicator faces that are hinged to said fixing part and extend as far as a distal end of the applicator in a main direction of longitudinal extension, said rounded applicator faces having a radius of curvature of less than 6 mm, said fixing part comprising a sleeve, said application part being connected to said sleeve by means of a flexible restriction, such that said application part is rotatable relative to said sleeve about at least two axes of an orthonormal coordinate system, said restriction being rounded and substantially concave in shape, and when viewed in a plane that is transverse to said main direction, said rounded shape having a radius of curvature of less than 6 mm, and wherein said restriction has a circular cross section, that is transverse to the main direction, that is substantially circular in shape and the diameter of which is at least equal to 1.5 mm, wherein said support rod is substantially cylindrical in shape and has a diameter D, said application part having a diameter d, said two diameters D, d being linked by the following formula: $0.89 \leq d/d \leq 0.99$.

* * * * *